US005709535A

United States Patent [19]

Enomoto et al.

[11] Patent Number: 5,709,535

[45] Date of Patent: Jan. 20, 1998

[54] MULTI-CYLINDER RECIPROCATING COMPRESSOR HAVING IMPROVED DISCHARGE VALVE STOPPER ASSEMBLY

[75] Inventors: Katsutoshi Enomoto; Hisao Ichikawa; Kiyoshi Yoshii; Katsuhiko Arai, all of Kounan-machi, Japan

[73] Assignee: Zexel Corporation, Tokyo, Japan

[21] Appl. No.: 633,421

[22] Filed: Apr. 17, 1996

[30] Foreign Application Priority Data

Apr. 18, 1995 [JP] Japan ..... 7-116463
Sep. 5, 1995 [JP] Japan ..... 7-251759

[51] Int. Cl.[6] ..... F04B 27/08

[52] U.S. Cl. ..... 417/269; 417/560; 137/512.4

[58] Field of Search ..... 417/269, 560; 137/512.4

[56] References Cited

U.S. PATENT DOCUMENTS 1,416,771 5/1922 Babson et al. ..... 137/512.4
3,314,600 4/1967 Hadley ..... 137/512.4 X
4,181,477 1/1980 Litt ..... 137/512.4 X
4,976,284 12/1990 Horvarter ..... 417/269 X
5,477,773 12/1995 Murakami et al. ..... 417/269 X
5,483,867 1/1996 Ikeda et al. ..... 417/269 X

FOREIGN PATENT DOCUMENTS 4-44868 10/1992 Japan .

*Primary Examiner*—Richard E. Gluck
*Attorney, Agent, or Firm*—Frishauf, Holtz, Goodman, Langer & Chick

[57] ABSTRACT

A reciprocating compressor includes a cylinder block having a plurality of compression chambers formed therein and a cylinder head secured to the cylinder block and having a high-pressure chamber formed therein. A first member is arranged between the cylinder block and the cylinder head and has a plurality of discharge ports formed therethrough for communicating the plurality of compression chambers to the high-pressure chamber. The reciprocating compressor comprises a second member having a plurality of discharge valves formed therewith for opening and closing the plurality of discharge valves, and a third member having a plurality of stoppers formed therewith for each setting a proper limit to resilient deformation of a corresponding one of the plurality of stoppers.

16 Claims, 8 Drawing Sheets

MULTI-CYLINDER RECIPROCATING COMPRESSOR HAVING IMPROVED DISCHARGE VALVE STOPPER ASSEMBLY

BACKGROUND OF THE INVENTION

1. Field of the Invention

This invention relates to a reciprocating compressor, such as a swash plate compressor, a wobble plate compressor, and an in-line compressor (crank compressor), and more particularly to a reciprocating compressor which can be assembled with ease, and has an excellent volumetric efficiency.

2. Description of the Prior Art

Conventionally, as a reciprocating compressor, a swash plate compressor is known, for example, as proposed by Japanese Utility Model Publication (Kokoku) No. 4-44868.

The proposed swash plate compressor comprises a cylinder block having a plurality of compression chambers formed therein, a cylinder head which is secured to the cylinder block and has a discharge chamber formed therein, a valve plate arranged between the cylinder block and the cylinder head for separating the compression chambers from the discharge chamber, discharge ports formed through the valve plate for communicating the compression chambers to the discharge chamber, discharge valves for opening and closing the discharge ports, respectively, and stoppers each setting a limit to a valve lift amount of a corresponding one of the discharge valves.

FIG. 1 shows the valve plate, one of the discharge valves, and a corresponding one of the stoppers of the conventional swash plate compressor in an assembled state.

FIG. 2 shows the valve plate, the discharge valves, and the stoppers in an exploded state.

The valve plate 503 has discharge ports 503*a* and rivet holes 503*c* formed therethrough, and the number of the discharge ports 503*a* and that of the rivet holes 503*c* are each identical to that of the compression chambers. One end of each discharge valve 527 has a rivet hole 527*c* formed therethrough. One end of each stopper 529 has a rivet hole 529*c* formed therethrough, and the other end of the same is bent into a predetermined angle. To fix the discharge valve 527 and the stopper 529 onto the valve plate 503, first, the discharge valve 527 and the stopper 529 are placed on the valve plate 503, one upon the other, and then the rivet hole 503*c* of the valve plate 503, the rivet hole 527*c* of the discharge valve 527, and the rivet hole 529*c* of the stopper 529 are aligned. After inserting a rivet 540 through the rivet holes 529*c*, 527*c*, and 503*c*, the discharge port 503*a* of the valve plate 503, and the other end of the discharge valve 527 and the other end of the stopper 529 are aligned. Finally, a portion of the rivet 540 protruded out of the rivet hole 503*c* of the valve plate is hammered to form a head (see FIG. 1). Thus, the discharge valve 527 and the stopper 529 are fixed to the valve plate 503.

In the conventional swash plate compressor, the discharge valves 527 are required to be provided in separate pieces the same number as the number of the compression chambers, and this is also the case with the stoppers 529. Therefore, the number of component parts is large, and a riveting operation is required to be carried out the same number of times as the number of compression chambers, which prevents these component parts from being assembled with ease and requires much labor. Moreover, the distance between the bent end of the stopper 529 and the other end of the discharge valve 527 can be varied by hammering of the rivet 540.

Further, since the valve plate 503 is given a role in withstanding pressure of a compressed refrigerant gas within the compression chamber, it is required to have a predetermined level of rigidity, so that it is designed to have a large thickness compared with that of the discharge valve 527 and that of the stopper 529. Accordingly, the volume or space in the discharge port 503*a* is large, which increases dead volume of the compression chamber, resulting in a low volumetric efficiency of the compressor.

In one type of compressor, a plurality of discharge valves are fixed by a single rivet. In this case, however, a step is necessary in which the discharge valves are each positioned for ease of respective discharge valves, which makes it difficult to carry out assembly work and requires much labor.

SUMMARY OF THE INVENTION

It is an object of the invention to provide a reciprocating compressor which can be assembled more easily, and has an enhanced volumetric efficiency through reduction of dead volume of each compression chamber.

To attain the above object, the present invention provides a reciprocating compressor comprising:

a cylinder block having a plurality of compression chambers formed therein;

a cylinder head secured to the cylinder block and having a high-pressure chamber formed therein;

a first member arranged between the cylinder block and the cylinder head and having a plurality of discharge ports formed therethrough for communicating the plurality of compression chambers to the high-pressure chamber;

a second member having a plurality of discharge valves formed therewith for opening and closing the plurality of discharge valves, respectively; and a third member having a plurality of stoppers formed therewith for each setting a proper limit to resilient deformation of a corresponding one of the plurality of discharge valves.

According to the reciprocating compressor of the present invention, conventional discharge valves formed in separate pieces of the same number as the number of compression chambers are replaced by the second member having the plurality of discharge valves formed in one piece therewith, and conventional stoppers formed in separate pieces of the same number as the number of compression chambers are replaced by the third member having a plurality of stoppers formed in one piece therewith. Therefore, the number of component parts is reduced, and it is no longer necessary to carry out fixing of a discharge valve and a stopper to a valve plate (e.g. by the use of fixing means, such as a rivet or a bolt) the same number of times as the number of the compression chambers, as is the case with the prior art, which makes it possible to reduce the manufacturing cost.

Preferably, the plurality of discharge valves are each formed by cutting a portion of the second member into a tongue shape, and the plurality of stoppers are each formed by cutting a portion of the third member into a tongue shape, the first member, the second member, and the third member being arranged between the cylinder block and the cylinder head, one upon another.

According to this preferred embodiment, during assembly of the first to third members to the cylinder block, the first to third members can be set on the cylinder block by simply placing the first to third members on the cylinder block, one upon another, which simplifies assembly work, and hence the manufacturing cost can be reduced.

In one preferred embodiment, the cylinder head has a low-pressure chamber formed therein, and the first member is a valve plate which separates the plurality of compression chambers from the high-pressure chamber and the low-pressure chamber.

Preferably, the third member is formed to have a thickness which makes the third member rigid enough not to be deformed by pressure of compressed refrigerant gas in the plurality of compression chambers to such an extent as will permit communication between the high-pressure chamber and the low-pressure chamber, and the valve plate has a thickness smaller than the thickness of the third member.

According to this preferred embodiment, since the third member is formed to have a thickness which makes the third member rigid enough not to be deformed by pressure of compressed refrigerant in the plurality of compression chambers to such an extent as will permit communication between the high-pressure chamber and the low-pressure chamber, the third member is given a role in withstanding pressure of the compressed refrigerant gas, which was assigned, in the prior art, to the valve plate. Therefore, it is possible to make the thickness of the valve plate smaller than that of a conventional valve plate, so that the volume or space in the discharge ports can be reduced to reduce dead volume of each compression chamber.

Further preferably, the second member is formed of a spring plate material.

Also preferably, the third member is formed of one selected from a group consisting of at least a hot rolled steel and an aluminum alloy.

In another preferred embodiment, the cylinder head has a low-pressure chamber formed therein, the second member having a plurality of suction port portions formed therewith the third member has a plurality of suction port portions formed therewith, the plurality of suction port portions of the second member are opposed to the plurality of suction port portions of the third member, respectively, to form a plurality of suction ports, and the first member has a plurality of suction valves formed therewith for opening and closing the plurality of suction ports, respectively.

According to this preferred embodiment, a plurality of discharge valves are formed in a single member (second member), and also a plurality of suction valves are formed in a single member (first member), whereby a valve plate is omitted to reduce the number of component parts, which makes it possible to reduce cost and labor of manufacturing the compressor.

Preferably, the plurality of discharge valves are each formed by cutting a portion of the second member into a tongue shape, and the plurality of stoppers are each formed by cutting a portion of the third member into a tongue shape, wherein the first member, the second member, and the third member are arranged between the cylinder block and the cylinder head, one upon another.

According to this preferred embodiment, during assembly of the first to third members to the cylinder block, the first to third members can be set on the cylinder block by simply placing the first to third members on the cylinder block, one upon another, which simplifies assembly work, and hence the manufacturing cost can be reduced.

Preferably, the third member is formed to have a thickness which makes the third member rigid enough not to be deformed by pressure of compressed refrigerant in the plurality of compression chambers to such an extent as will permit communication between the high-pressure chamber and the low-pressure chamber, and the first member having a thickness smaller than the thickness of the third member.

According to this preferred embodiment, since the third member is formed to have a thickness which makes the third member rigid enough not to be deformed by pressure of compressed refrigerant in the plurality of compression chambers to such an extent as will permit communication between the high-pressure chamber and the low-pressure chamber, the third member is given a role in withstanding pressure of compressed refrigerant gas, which was assigned, in the prior art, to the valve plate, and further, the discharge ports are formed through the first member. Therefore, it is possible to make the thickness of the first member smaller than that of a conventional valve plate, so that the volume or space in the discharge ports can be reduced to reduce dead volume of each compression chamber.

In another preferred embodiment, the cylinder head has a low-pressure chamber formed therein, the third member has a plurality of suction ports formed therethrough for communicating the plurality of compression chambers to the low-pressure chamber, the second member has a plurality of suction valves formed therewith for opening and closing the plurality of suction ports, respectively, and the first member has a plurality of relief recesses formed therethrough for the plurality of suction valves, respectively.

According to this preferred embodiment, the plurality of discharge valves and the plurality of suction valves are formed in a single member (second member), whereby a valve plate is omitted. Therefore, the number of component parts is reduced, whereby the labor and cost of manufacturing the compressor can be reduced.

The above and other objects, features and advantages of the present invention will become more apparent from the following detailed description taken in conjunction with the accompanying drawings.

DETAILED DESCRIPTION OF THE PREFERRED EMBODIMENTS

The invention will now be described in detail with reference to drawings showing preferred embodiments of the invention.

Figure 3:
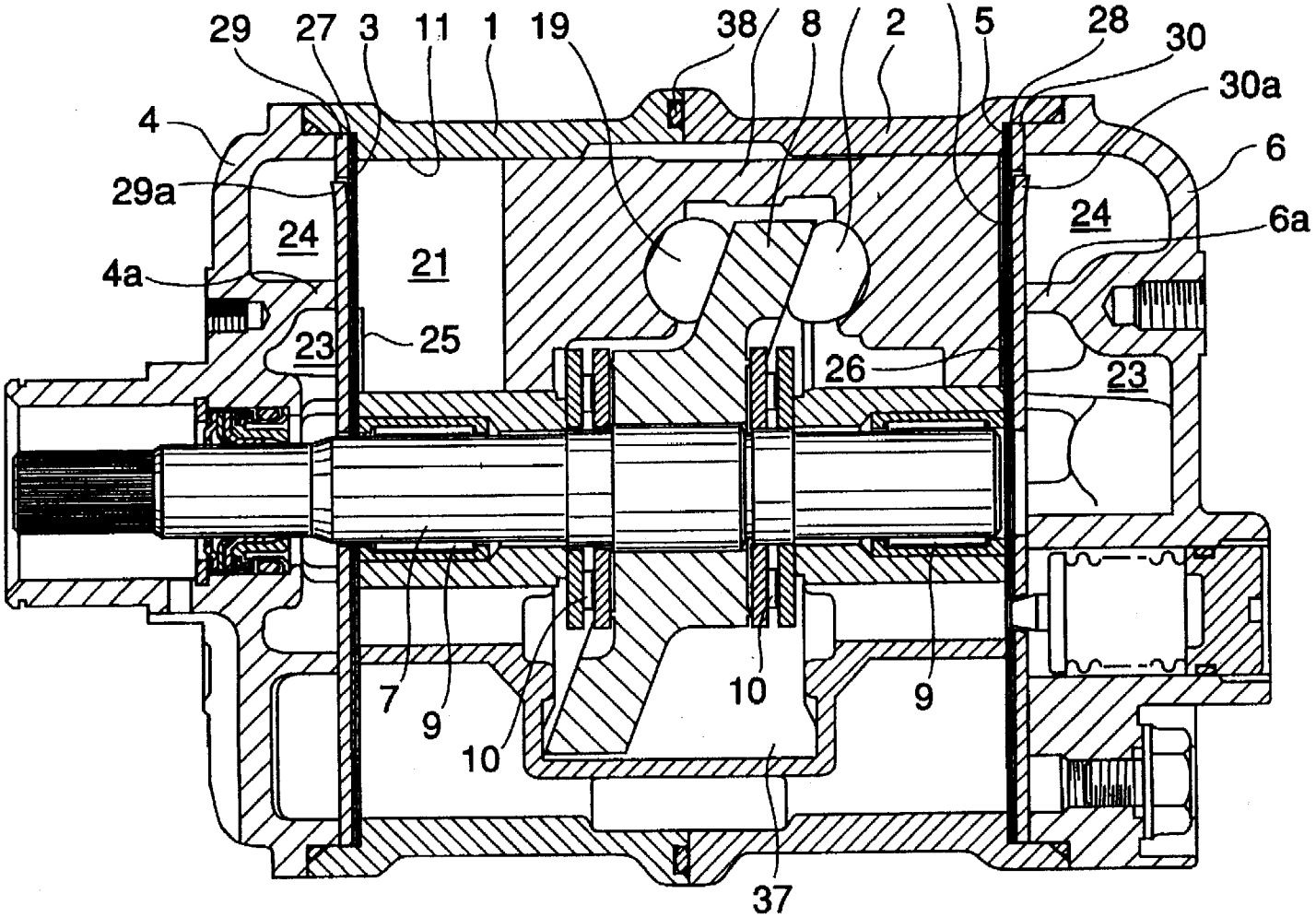
FIG. 3 is a longitudinal sectional view showing the whole arrangement of a swash plate compressor according to a first embodiment of the invention.

Referring first to FIG. 3, there is shown the whole arrangement of a swash plate compressor according to a first embodiment of the invention.

The compressor has a cylinder block 1 on a front side, and a cylinder block 2 on a rear side, with respective opposed ends joined to each other via an O ring to form a combined cylinder block 1,2. The combined cylinder block 1,2 has one end thereof secured to a front head (cylinder head) 4 via a valve plate 3, a discharge valve sheet 27, and a stopper sheet 29, and the other end thereof secured to a rear head (cylinder head) 6 via a valve sheet 5, a discharge valve sheet 28, and a stopper sheet 30.

A drive shaft 7 extends through the center of the combined cylinder block 1,2, and a swash plate 8 is rigidly fitted on the drive shaft 8. The drive shaft 7 and the swash plate 8 are rotatably supported in the cylinder block via bearings 9, 10. The swash plate 8 is received in a swash plate chamber 37 formed in a joined part of the combined cylinder block 1,2.

The combined cylinder block 1,2 has three cylinder bores 11 formed therethrough. Each cylinder bore is parallel to the axis of the drive shaft 7, and arranged at predetermined circumferentially-spaced intervals around the drive shaft 7. Each cylinder bore 11 has a piston 12 slidably received therein. Within each cylinder bore 11, compression chambers 21, 22 are formed on opposite ends of the piston 12. The piston 12 is connected to the swash plate 8 via a pair of substantially hemispherical shoes 19, 20, whereby the piston 12 reciprocates within the cylinder bore 11 according to rotation of the swash plate 8.

Figure 4:
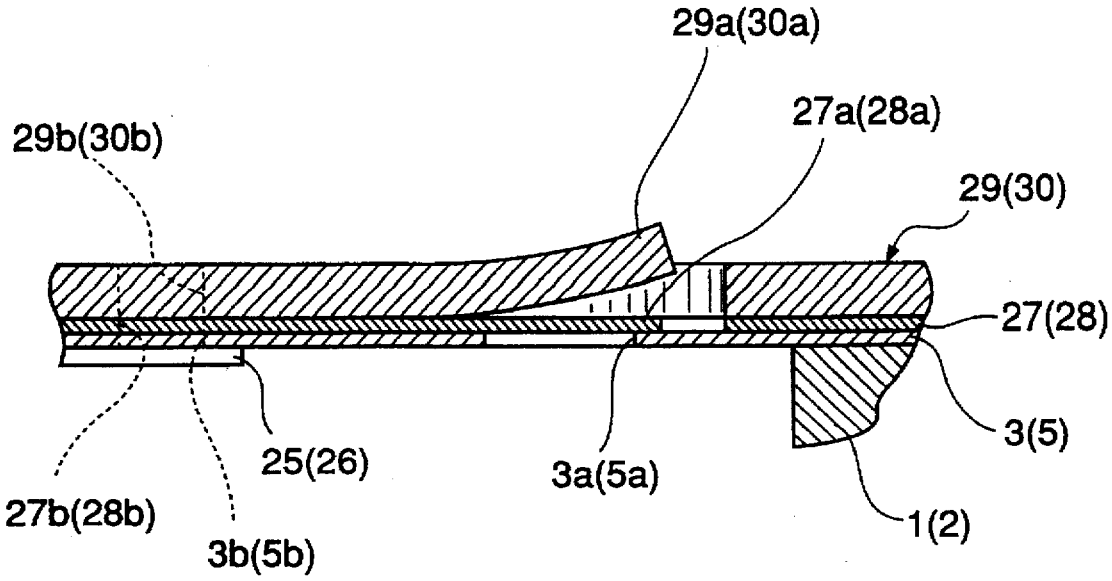
FIG. 4 is an enlarged sectional view showing part of the FIG. 3 swash plate compressor.
Figure 5:
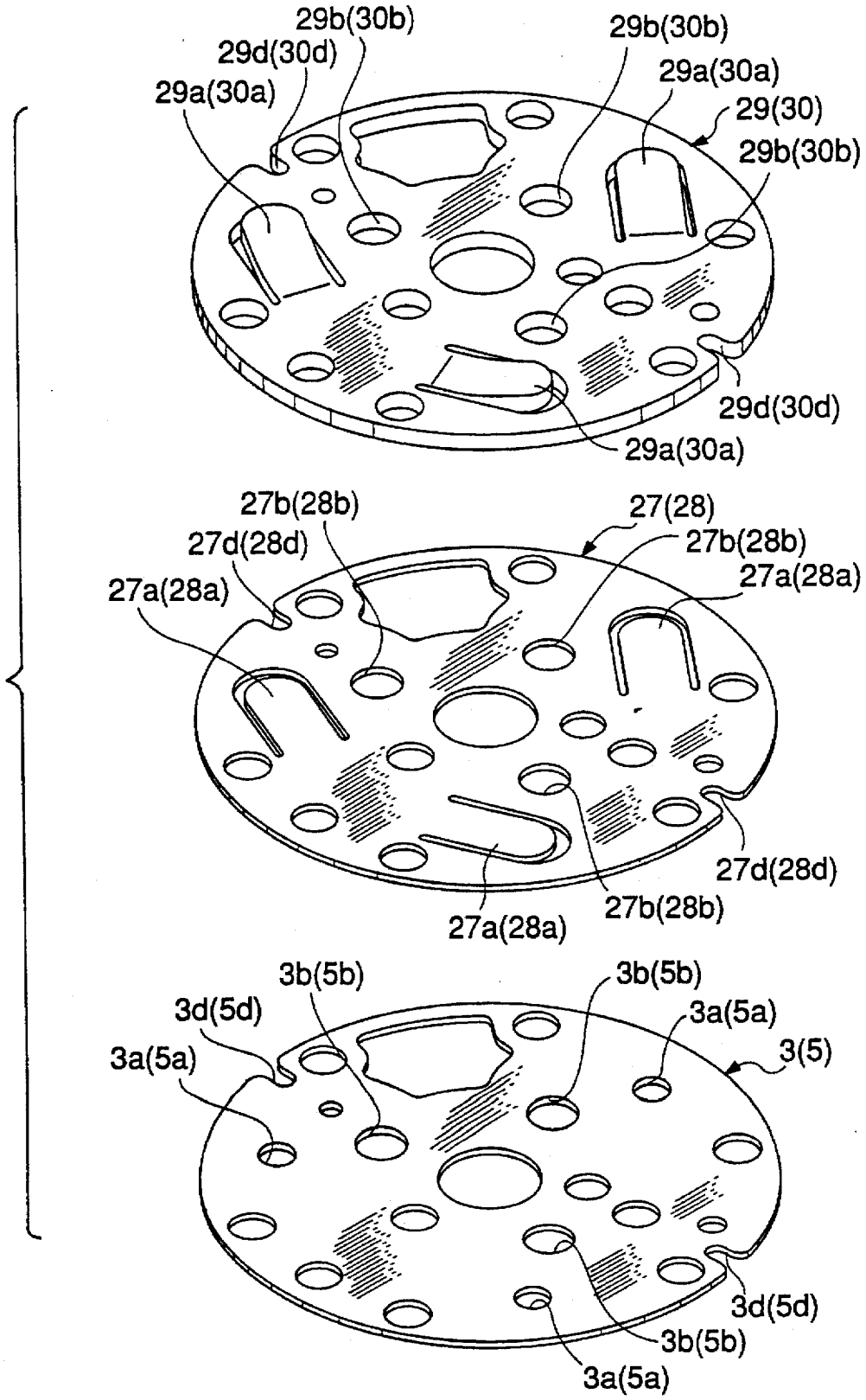
FIG. 5 is an exploded perspective view showing a valve sheet, a discharge valve sheet, and a stopper sheet, of the FIG. 3 swash plate compressor.

FIG. 4 shows part of the FIG. 3 swash plate compressor on an enlarged scale, while FIG. 5 shows the valve plate, the discharge valve sheet, and the stopper sheet, in an exploded state. In the following description, the other of each pair of members is indicated for reference by a reference numeral in immediately following round brackets.

The valve plate 3(5), which is substantially disk-shaped, has suction ports 3*b*(5*b*) and discharge ports 3*a*(5*a*) formed therethrough. The valve plate 3(5) is formed e.g. of a hot rolled steel (SPHC) or the like.

The discharge valve sheet 27(28), which is substantially disk-shaped, has discharge valve portions 27*a*(28*a*) each cut into a tongue shape, and through holes 27*b*(28*b*) opposed to the suction ports 3*b*(5*b*), respectively. The discharge valve sheet 27(28) is formed e.g. of a plate spring material.

The stopper sheet 29(30), which is substantially disk-shaped, has stopper portions 29*a*(30*a*) each cut into a tongue shape, and through holes 29*b*(30*b*) opposed to the holes 27*b*(28*b*), respectively. A protruding end of each stopper portion is bent into a predetermined angle or at a predetermined curvature (see FIG. 4) for setting a proper limit to resilient deformation of the discharge valve portion 27*a* (28*a*). The stopper is formed e.g. of a hot rolled steel (SPHC), an aluminum alloy, or the like.

Figure 1:
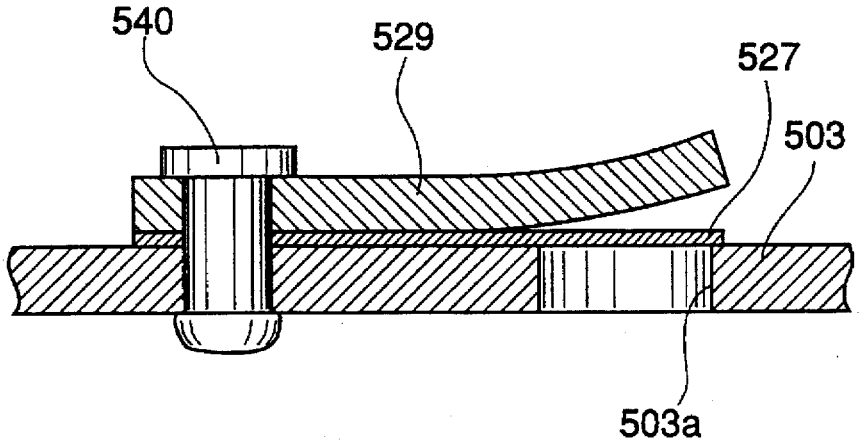
FIG.1 PRIOR ART
FIG. 1 is an enlarged sectional view showing part of a valve plate, a discharge valve, and a stopper, of a conventional swash plate compressor, in an assembled state.
Figure 2:
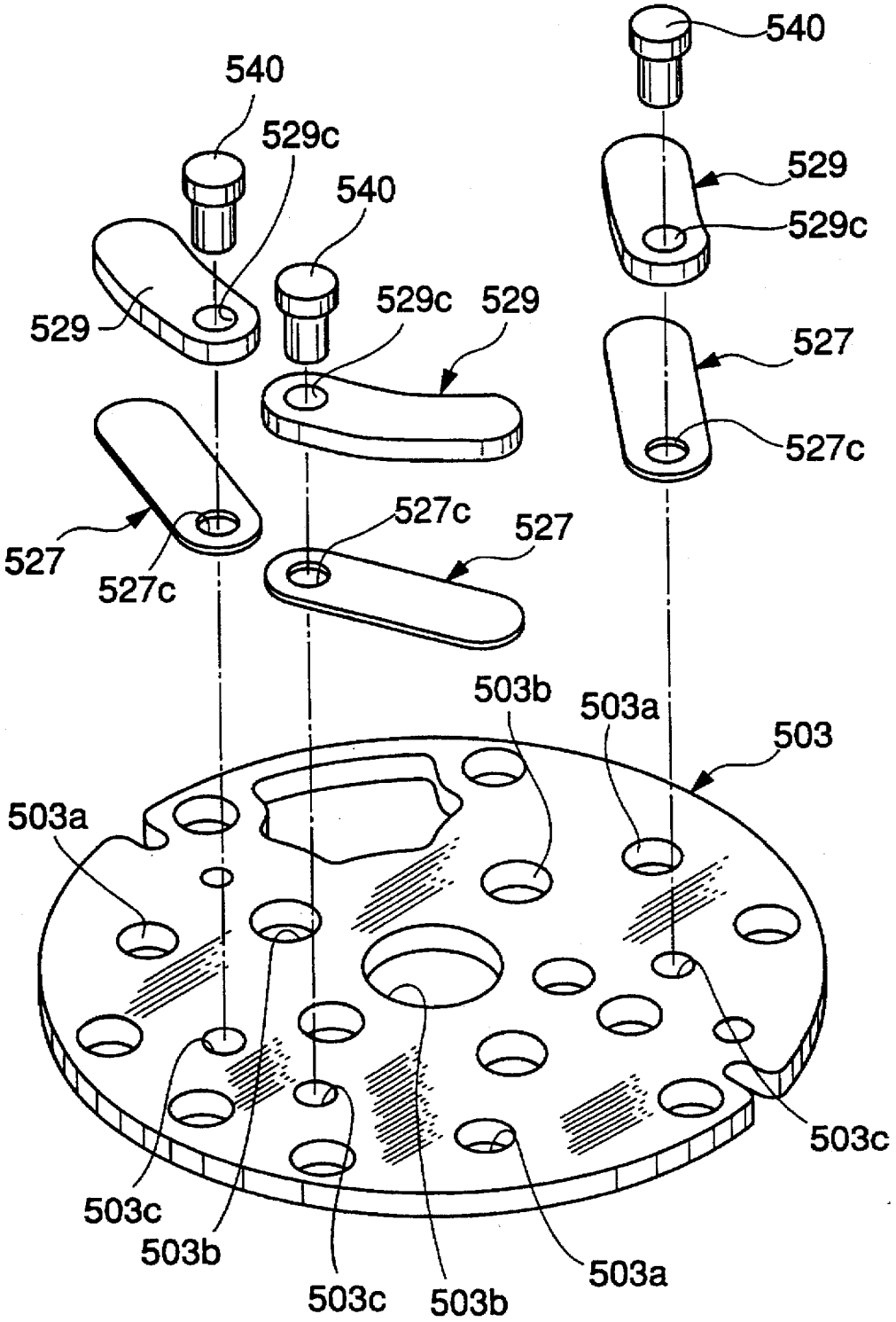
FIG.2 PRIOR ART
FIG. 2 is an exploded perspective view showing the valve plate, discharge valves, and stoppers, of the conventional swash plate compressor.

The stopper sheet 29(30) has a thickness which makes the stopper sheet 29(30) rigid enough not to be deformed by pressure of a compressed refrigerant gas within the compression chamber 21(22) to such an extent as will permit communication between the discharge chamber (high-pressure chamber) 24 and the suction chamber (low-pressure chamber) 23, i.e. a thickness sufficient for withstanding the pressure of the compressed refrigerant gas within the compression chamber 21(22). Thus, the stopper sheet 29(30) is formed to have rigidity which is equivalent to that of the conventional valve plate 503 described hereinabove with reference to FIGS. 1 and 2 and sufficient for withstanding the pressure of the compressed refrigerant gas, and in exchange, the thickness of the valve plate 3(5) is made smaller than that of the stopper sheet 29(30), as shown in FIG. 4. If the stopper sheet 29(30) does not have sufficient rigidity for withstanding the pressure of compressed refrigerant gas, there is formed a gap between a cylinder head-side end face of the stopper sheet 29(30) and a cylinder block-side end face of a partition wall 4*a*(6*a*) of the cylinder head, which permits communication between the discharge chamber 24 and the suction chamber 23.

Further, the valve plate 3(5), the discharge valve sheet 27(28), and the stopper sheet 29(30) are formed with cut-outs 3*d*(5*d*), 27*d*(28*d*), and 29*d*(30*d*), respectively. During assembly work, the cut-outs 3*d* to 30*d* are engaged with corresponding guide members, not shown, of the combined cylinder block 1,2 whereby the valve plate 3(5), the discharge valve sheet 27(28), and the stopper sheet 29(30) can be placed one upon another in respective predetermined positions.

As shown in FIG. 4, the discharge valve portions 27*a* (28*a*) are each opposed to a corresponding one of the discharge ports 3*a*(5*a*), and when one of the discharge valve portions 27*a*(28*a*) opens, a corresponding one of the compression chambers 21(22) is communicated to the discharge chamber 24 via a corresponding one of the discharge port 3*a*(5*a*).

Further, the compressor has suction valves 25(26) arranged on the valve plate 3(5), each of which is opposed to a corresponding one of the suctions ports 3*b*(5*b*), and when one of the suction valves 25(26) opens, a corresponding one of the compression chambers 21(22) is communicated to the suction chamber 23 via a corresponding one of the suction port 3*b*(5*b*), the through hole 27*b*(28*b*) of the discharge valve sheet 27(28), and the through hole 29*b*(30*b*) of the stopper sheet 29(30).

Next, the operation of the swash plate compressor according to the present invention will be described.

As the drive shaft 7 rotates, the swash plate 8 is rotated in unison therewith. According to the rotation of the swash plate 8, the piston 12 reciprocates within the cylinder bore 11. When the swash plate 8 turns to one half-turn from a position in which the piston 12 is closest to the valve plate 3 (left limit of travel as viewed in FIG. 3), i.e. the piston 12 is in a top dead center position within the compression chamber 21, the piston is moved to a position shown in FIG. 3 (right limit of travel as viewed in FIG. 3), whereby the suction stroke is completely carried out for the compression chamber 21 and the compression stroke is completely carried out for the compression chamber 22. From this position, when the swash plate 8 further turns to one half-turn, inversely, the suction stroke is completely carried out for the compression chamber 22 and the compression stroke is completely carried out for the compression chamber 21. During the suction stroke, the suction valve 25 or 26 opens to introduce refrigerant gas via the suction port 3*b* or 5*b*, the through hole 27*b* or 28*b*, and the through hole 29*b* or 30*b* into the compression chamber 21 or 22. During the compression stroke, refrigerant gas compressed within the compression chamber 21 or 22 forces the discharge valve portion 27*a* or 28*a* to open whereby the high-pressure refrigerant gas is discharged from the compression chamber 21 or 22 via the discharge port 3*a* or 5*a* into the discharge chamber 24.

According to the swash plate compressor of the present embodiment, the stopper sheets 29 and 30 are each formed to have a thickness which makes the stopper sheets 29 and 30 rigid enough not to be deformed by pressure of compressed refrigerant gas to such an extent as will permit communication between the discharge chamber 24 and the suction chamber 23, thereby giving each of the stopper sheets 29 and 30 a role of withstanding the pressure of the compressed refrigerant gas. Therefore, it is possible to make the thickness of the valve plates 3 and 5 smaller than that of the conventional valve plate 503 shown in FIGS. 1 and 2, thereby reducing the volume or space in each of the discharge ports 3*a* and 5*a*. As a result, the dead volume of each compression chamber can be reduced to enhance volumetric efficiency of the compressor.

Further, the discharge valves 527 (FIG. 2) of the prior art, which are provided in the same number as the number of the compression chambers 21(22), are replaced by the discharge valve sheets 27(28) each having the discharge valve portions 27*a*(28*a*) equivalent in operation to the discharge valves 527, and the stoppers 529 (FIG. 2) of the prior art, which are provided in the same number as the number of the compression chambers 21(22), are replaced by the stopper sheets 29(30) each having the stopper portions 29*a*(30*a*) equivalent in operation to the stoppers 529. Therefore, the number of component parts is reduced compared with the prior art, and moreover, the valve plate 3(5), the discharge valve sheet 27(29), and the stopper sheet 29(30) can be assembled to the cylinder blocks 1(2) by simply placing these component parts on the cylinder blocks 1(2), one upon another, which makes it unnecessary to carry out the prior art assembly operation of fixing the discharge valve 527 and the stopper 529 to the valve plate 503 the same number of times as the number of the compression chambers 21 and 22, which increases the ease of assembly of these component parts.

Further, if the discharge ports 3*a* and 5*a* are provided in the valve plates 3 and 5 at locations closer to the inner peripheral surface of the cylinder bore 11, it is possible to suppress deformation of inner peripheral portions of the valve plates 3 and 5 respectively defining the discharge ports 3*a* and 5*a*.

Figure 7:
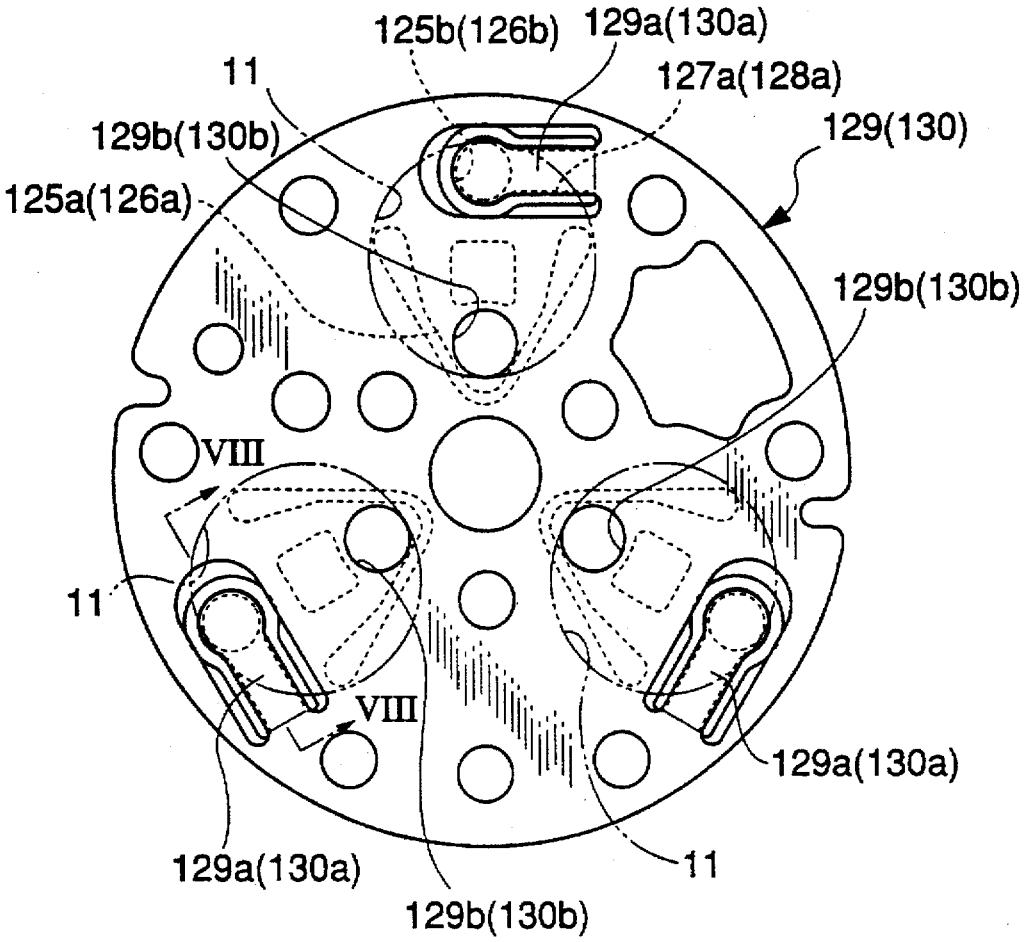
FIG. 7 is a plan view showing the stopper sheet, the discharge valve sheet, and the suction valve sheet, of the FIG. 6 swash plate compressor, in an assembled state.
Figure 8:
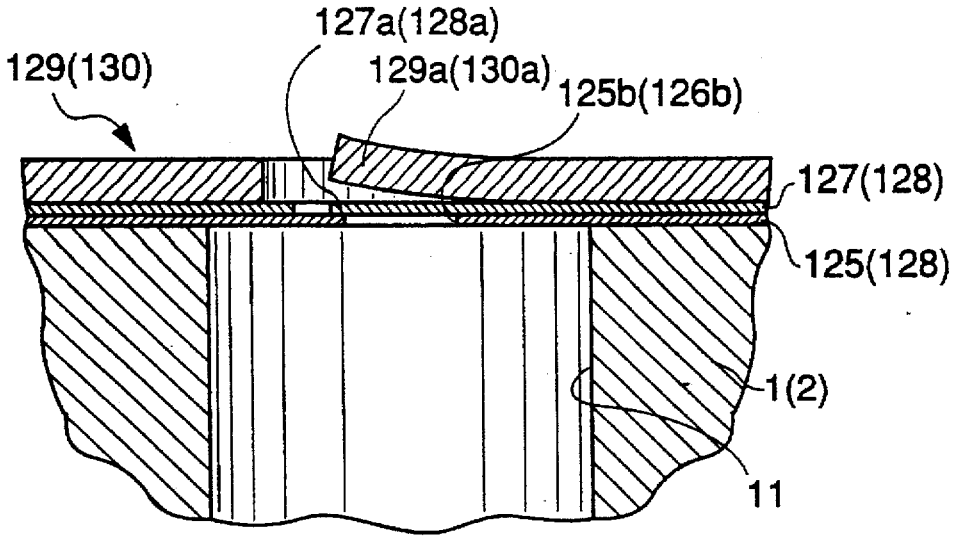
FIG. 8 is a cross-sectional view take along line VIII—VIII of FIG. 7.

Next, a swash plate compressor according to a second embodiment of the invention will be described with reference to FIGS. 6 to 8.

Figure 6:
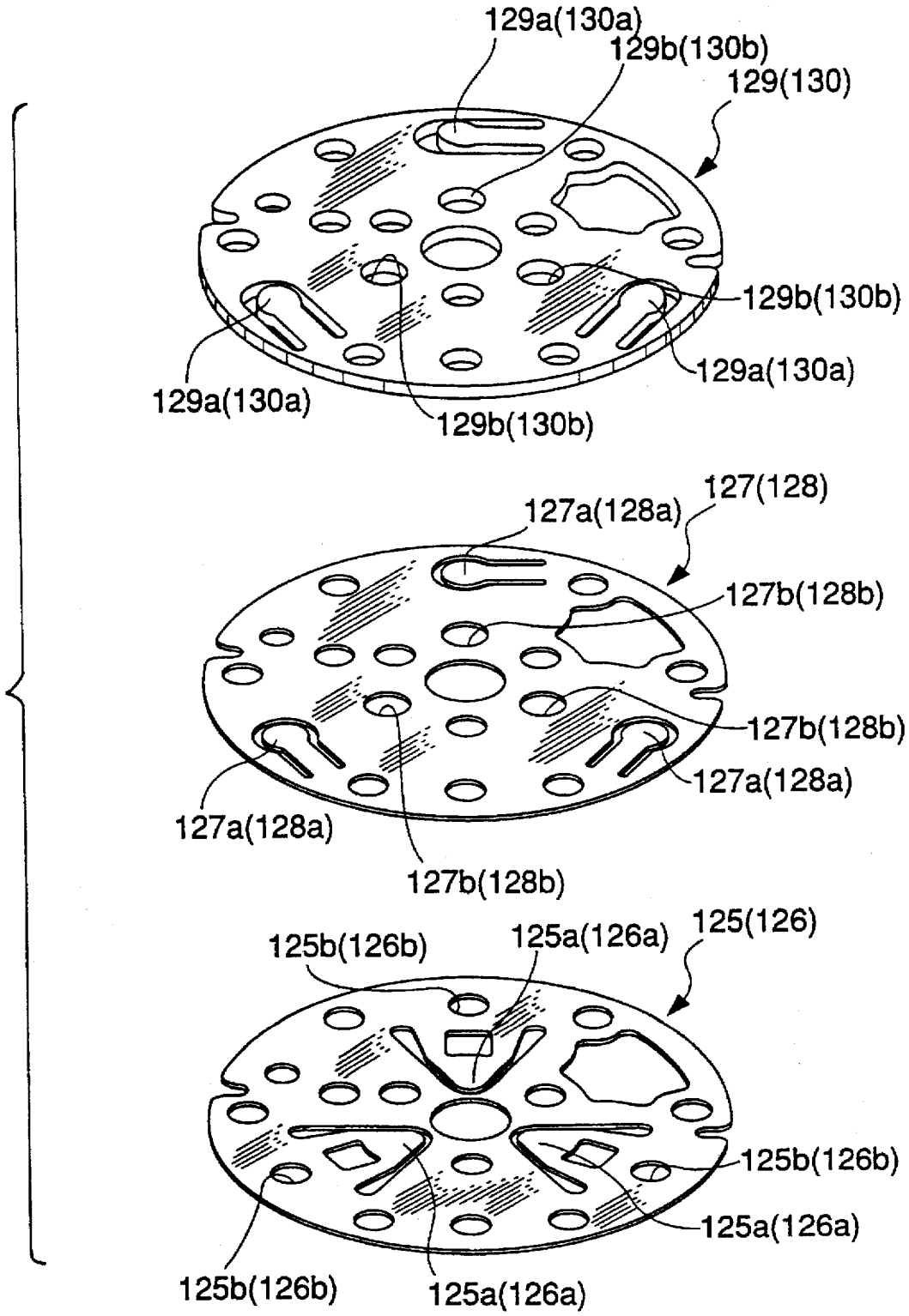
FIG. 6 is an exploded perspective view showing a stopper sheet, a discharge valve sheet, and a suction valve sheet, of a swash plate compressor according to a second embodiment of the invention.

FIG. 6 shows a stopper sheet, a discharge valve sheet, and an suction valve sheet, of a swash plate compressor according to the second embodiment, in an exploded state. FIG. 7 shows the stopper sheet, the discharge valve sheet, and the suction valve sheet, appearing in FIG. 6, in an assembled state. FIG. 8 shows a cross-section of an assembly shown in FIG. 7, taken along line VIII—VIII of FIG. 7. In the following description of the second embodiment, the same component parts as appear in FIGS. 3 to 5 will be referred to by the same reference numerals, and detailed description thereof is omitted.

The combined cylinder block 1,2 has one end thereof secured to the front head (cylinder head) 4 via a suction valve sheet 125, a discharge valve sheet 127, and a stopper sheet 129, and the other end thereof secured to the rear head (cylinder head) 6 via a suction valve sheet 126, a discharge valve sheet 128, and a stopper sheet 130.

The suction valve sheet 125(126), which is substantially disk-shaped, has suction valve portions 125*a*(126*a*) therethrough and discharge ports 125*b*(126*b*) formed therethrough, each of the suction valve portions being cut into a tongue shape. The suction valve sheet 125(126) is formed e.g. of a spring plate material. The discharge valve sheet 127(128), which is substantially disk-shaped, has discharge valve portions 127*a*(128*a*) and suction ports 127*b* (128*b*) formed therethrough, each of the discharge valve portions being cut into a tongue shape. The discharge valve sheet 127(128) is formed e.g. of a plate spring material. The stopper sheet 129(130), which is substantially disk-shaped, has stopper portions 129*a*(130*a*) each cut into a tongue shape, and suction ports 129*b*(130*b*) opposed to the suction ports 127*b*(128*b*), respectively. A protruding end of each stopper portion 129*a*(130*a*) is bent into a predetermined angle or at a predetermined curvature (see FIG. 8) for setting a proper limit to resilient deformation of the discharge valve portion 127*a*(128*a*) of the discharge valve sheet 127(128). The stopper sheet 129(130) is formed e.g. of a hot rolled steel (SPHC), an aluminum alloy, or the like.

The stopper sheets 129 and 130 each have a thickness which makes the stopper sheets 129 and 130 rigid enough not to be deformed by pressure of compressed refrigerant gas to such an extent as will permit communication between the discharge chamber 24 and the suction chamber 23, i.e. they have rigidity sufficient for withstanding the pressure of the compressed refrigerant gas.

According to the swash plate compressor of the present embodiment, a plurality of discharge valve portions 127*a* (128*a*) are formed in a single sheet (the discharge valve sheet 127(128)) and a plurality of suction valve portions 125*a*(126*a*) are also formed in a single sheet (the suction valve sheet 125(126)), whereby the valve plate is omitted to reduce the number of component parts. Further, compared with the prior art, the volume or space of the discharge valve ports 125*b*, 126*b* is reduced, which reduces dead volume of the compression chamber, whereby volumetric efficiency of the compressor can be enhanced.

Figure 10:
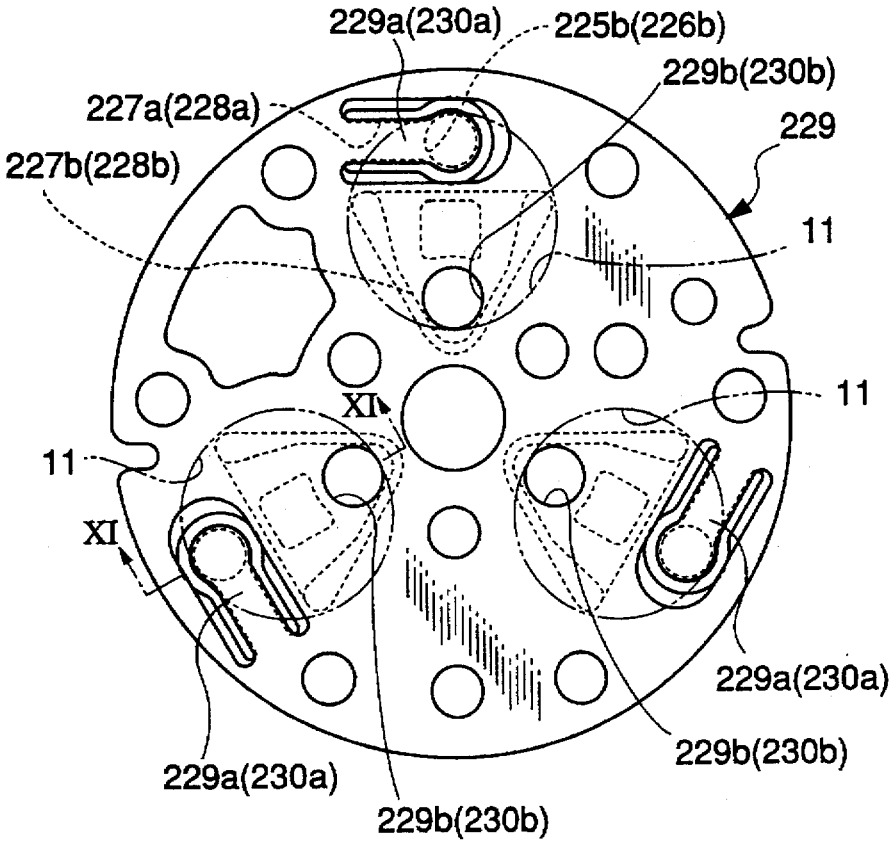
FIG. 10 is a plan view showing the stopper sheet, the valve sheet, and the plate, of the FIG. 9 swash plate compressor, in an assembled state.
Figure 11:
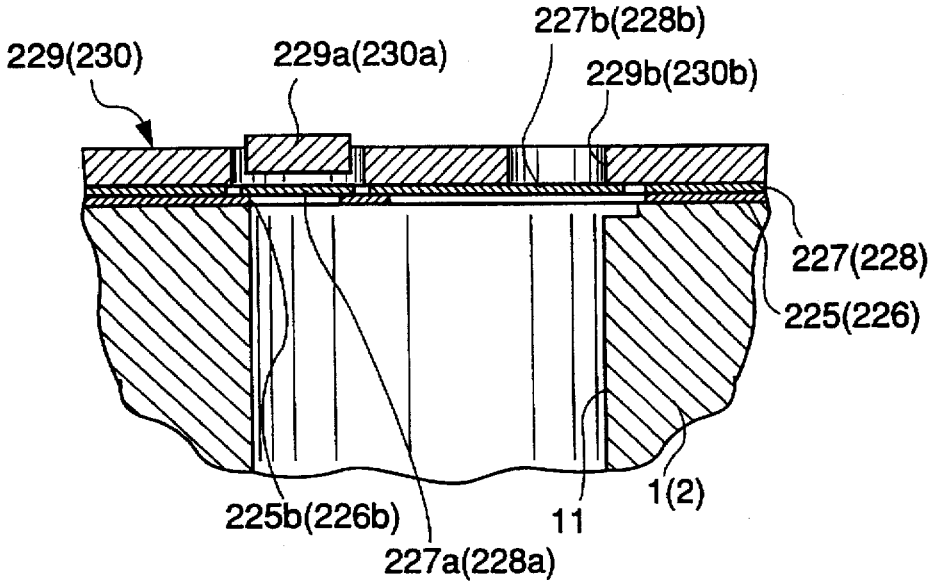
FIG. 11 is a cross-sectional view taken along line XI—XI of FIG. 10.

Next, a swash plate compressor according to a third embodiment of the invention will be described with reference to FIGS. 9 to 11.

Figure 9:
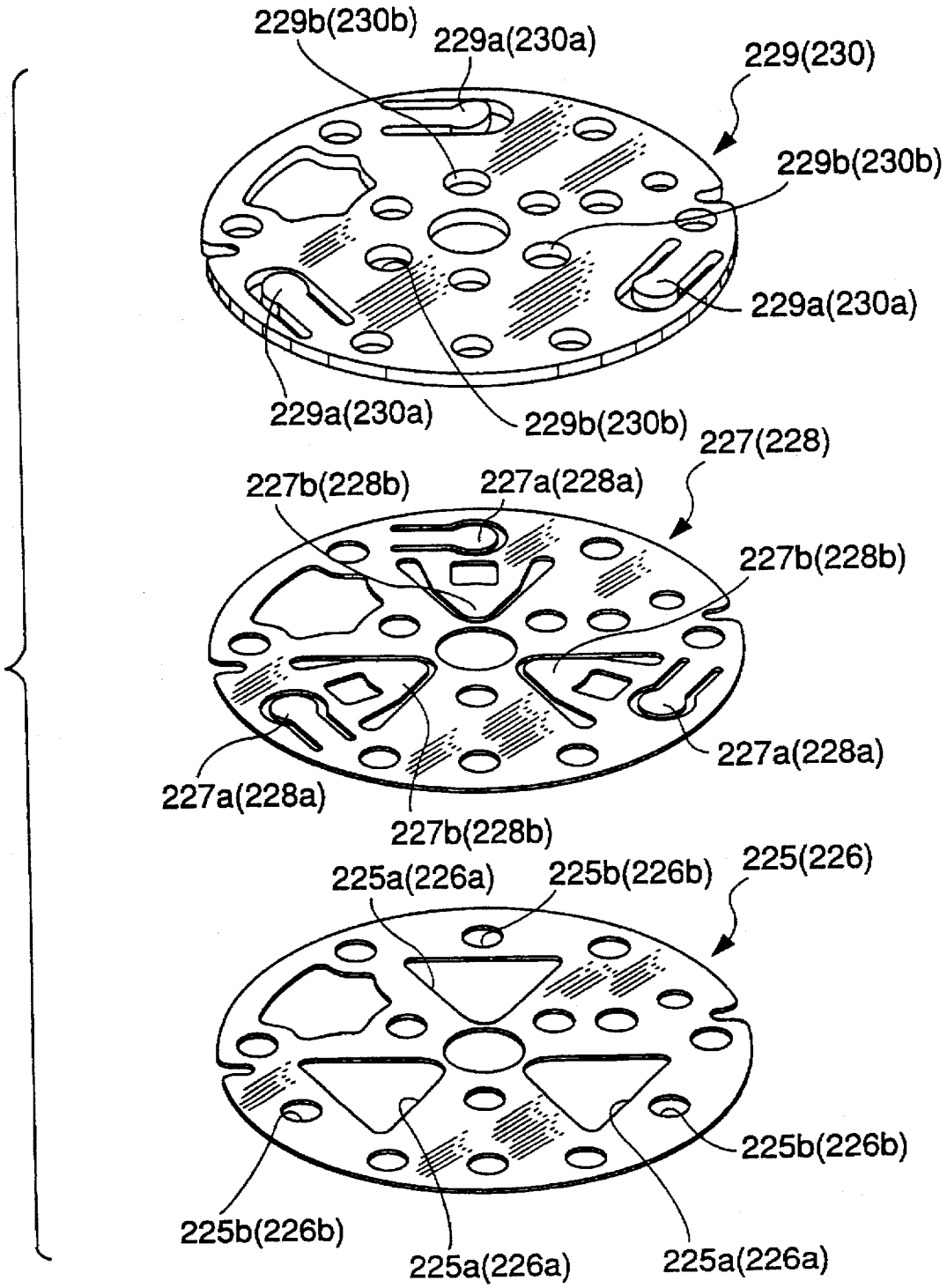
FIG. 9 is an exploded perspective view showing a stopper sheet, a valve sheet, and a plate, of a swash plate compressor according to a third embodiment of the invention.

FIG. 9 shows a stopper sheet, a valve sheet, and a plate, of a swash plate compressor according to the third embodiment, in an exploded state. FIG. 10 shows the stopper sheet, the valve sheet, and the plate, appearing in FIG. 9, in an assembled state. FIG. 11 shows a cross-section of an assembly shown in the FIG. 10, taken along line XI—XI of FIG. 10. In the following description of the third embodiment, the same component parts as appear in FIGS. 3 to 5 will be referred to by the same reference numerals, and detailed description thereof is omitted.

The combined cylinder block 1,2 has one end thereof secured to the front head (cylinder head) 4 via a plate 225, a valve sheet 227, and a stopper sheet 229, and the other end thereof secured to the rear head (cylinder head) 6 via a plate 226, a valve sheet 228, and a stopper sheet 230.

The plate 225(226), which is substantially disk-shaped, has relief recesses 225*a*(226*a*) and discharge ports 225*b* (226*b*) formed therethrough, the relief recesses 225*a*(226*a*) being provided for suction valve portions 227*b*(228*b*), referred to below. The valve sheet 227(228), which is substantially disk-shaped, has the suction valve portions 227*b*(228*b*) each cut into a tongue shape, and discharge valve portions 227*a*(228*a*) each cut into a tongue shape. The valve sheet 227(228) is formed e.g. of a plate spring material.

The stopper sheets 229(230), which is substantially disk-shaped, has stopper portions 229*a*(230*a*) each cut into a tongue shape, and suction ports 229*b*(230*b*) formed therethrough. A protruding end of each stopper portion 229*a*

(230*a*) is bent into a predetermined angle or at a predetermined curvature for setting a proper limit to resilient deformation of the discharge valve portion 227*a*(228*a*) of the discharge valve sheet 227(228). The stopper sheet 229 (230) is formed e.g. of a hot rolled steel (SPHC), an aluminum alloy, or the like.

The stopper sheets 229 and 230 each have a thickness which makes the stopper sheets 229 and 230 rigid enough not to be deformed by pressure of compressed refrigerant gas to such an extent as will permit communication between the discharge chamber 24 and the suction chamber 23, i.e. they have rigidity sufficient for withstanding the pressure of the compressed refrigerant gas.

According to the swash plate compressor of the present embodiment, it is possible to obtain the same effects as obtained by the second embodiment. Further, compared with the second embodiment, since a plate spring material is used for only one member (the valve sheet 227(228)) for one side of the compression chambers 21(22), which makes it possible to reduce the manufacturing cost.

Although in the above embodiments, description is made of cases whether the invention is applied to a swash plate compressor, this is not limitative, but the invention may be applied to various types of reciprocating compressors, such as a wobble plate compressor and a inline compressor (crank compressor).

What is claimed is:

1. A reciprocating compressor comprising:

a cylinder block having a plurality of compression chambers formed therein, said compression chambers being formed on opposite ends of respective pistons slidably received within respective cylinder bores;

a cylinder head secured to said cylinder block and having a high-pressure chamber formed therein;

an input port for introducing fluid into said plurality of compression chambers;

a first member arranged between said cylinder block and said cylinder head and having a plurality of discharge ports formed therethrough for communicating said plurality of compression chambers to said high-pressure chamber;

a second member having a plurality of discharge valves formed therewith for opening and closing said plurality of discharge ports, respectively; and a third member having a plurality of stoppers formed therewith, each of said plurality of stoppers setting a limit to resilient deformation of a corresponding one of said plurality of discharge valves.

2. A reciprocating compressor according to claim 1, wherein:

said plurality of discharge valves each comprise a tongue shaped portion cut from said second member, said plurality of stoppers each comprise a tongue shaped portion cut from said third member, and said first member, said second member, and said third member are arranged between said cylinder block and said cylinder head, one upon another.

3. A reciprocating compressor according to claim 1, wherein:

said cylinder head has a low-pressure chamber formed therein, and said first member comprises a valve plate which separates said plurality of compression chambers from said high-pressure chamber and said low-pressure chamber.

4. A reciprocating compressor according to claim 3, wherein:

said third member is formed to have a thickness which makes said third member rigid enough not to be deformed by a pressure of a compressed refrigerant in said plurality of compression chambers to such an extent as will permit communication between said high-pressure chamber and said low-pressure chamber, and said valve plate has a thickness smaller than said thickness of said third member.

5. A reciprocating compressor according to claim 4, wherein said second member comprises a spring plate material.

6. A reciprocating compressor according to claim 4, wherein said third member comprises at least one of a hot rolled steel and an aluminum alloy.

7. A reciprocating compressor according to claim 1, wherein:

a cylinder head has a low-pressure chamber formed therein, said input port comprises a plurality of suction ports portions formed in said second member and a plurality of suction port portions formed in said third member, said plurality of suction port portions of said second member being opposed to said plurality of suction port portions of said third member, respectively, to form a plurality of suction ports for communicating said plurality of compression chambers to said low-pressure chamber, and said first member has a plurality of suction valves formed therewith for opening and closing said plurality of suction ports, respectively.

8. A reciprocating compressor according to claim 7, wherein:

said plurality of discharge valves each comprise a tongue shaped portion cut from said second member, said plurality of stoppers each comprise a tongue shaped portion cut from said third member, and said first member, said second member, and said third member are arranged between said cylinder block and said cylinder head, one upon another.

9. A reciprocating compressor according to claim 7, wherein:

said third member is formed to have a thickness which makes said third member rigid enough not to be deformed by a pressure of a compressed refrigerant in said plurality of compression chambers to such an extent as will permit communication between said high-pressure chamber and said low-pressure chamber, and said first member has a thickness smaller than said thickness of said third member.

10. A reciprocating compressor according to claim 9, wherein said second member comprises a spring plate material.

11. A reciprocating compressor according to claim 9, wherein said third member comprises at least one of a hot rolled steel and an aluminum alloy.

12. A reciprocating compressor according to claim 1, wherein:

said cylinder head has a low-pressure chamber formed therein, said input port comprises a plurality of suction ports formed in said third member for communicating said plurality of compression chambers to said low-pressure chamber, said second member has a plurality of suction valves formed therewith for opening and closing said plurality of suction ports, respectively, and said first member has a plurality of relief recesses formed therethrough for said plurality of suction valves, respectively.

13. A reciprocating compressor according to claim 12, wherein:

said plurality of discharge valves each comprise a tongue shaped portion cut from said second member, said plurality of stoppers each comprise a tongue shaped portion cut from said third member, and said first member, said second member, and said third member are arranged between said cylinder block and said cylinder head, one upon another.

14. A reciprocating compressor according to claim 12, wherein:

said third member is formed to have a thickness which makes said third member rigid enough not to be deformed by a pressure of a compressed refrigerant in said plurality of compression chambers to such an extent as will permit communication between said high-pressure chamber and said low-pressure chamber, and said first member has a thickness smaller than said thickness of said third member.

15. A reciprocating compressor according to claim 14, wherein said second member comprises a spring plate material.

16. A reciprocating compressor according to claim 14, wherein said third member comprises at least one of a hot rolled steel and an aluminum alloy.

* * * * *